US006881032B2

(12) United States Patent
Malmborg

(10) Patent No.: US 6,881,032 B2
(45) Date of Patent: Apr. 19, 2005

(54) EXIT STATOR MOUNTING

(75) Inventor: Eric W. Malmborg, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 56 days.

(21) Appl. No.: 10/616,749

(22) Filed: Jul. 8, 2003

(65) Prior Publication Data

US 2005/0008486 A1 Jan. 13, 2005

(51) Int. Cl.[7] ..... F04D 29/54

(52) U.S. Cl. ..... 415/209.2; 415/215.1; 415/227

(58) Field of Search ..... 415/1, 138, 139, 415/209.2, 209.4, 215.1, 227, 228; 29/889.22, 889.1, 889.2

(56) References Cited

U.S. PATENT DOCUMENTS 5,249,921 A * 10/1993 Stueber et al. ..... 415/138

* cited by examiner

*Primary Examiner*—Edward K. Look
*Assistant Examiner*—Dwayne J. White
(74) *Attorney, Agent, or Firm*—Bachman & LaPointe, P.C.

(57) ABSTRACT

A gas turbine engine has an intermediate case. At least one compressor exit stator shroud is welded to the intermediate case.

20 Claims, 3 Drawing Sheets

EXIT STATOR MOUNTING

BACKGROUND OF THE INVENTION (1) Field of the Invention

The invention relates to gas turbine engines. More particularly, the invention relates to the mounting of low pressure compressor exit stators to turbine engine intermediate cases.

(2) Description of the Related Art

FIG. 1 shows a gas turbine engine 20 having a case assembly 22 containing concentric high and low pressure rotor shafts 24 and 25. The shafts are mounted within the case for rotation about an axis 500 which is normally coincident with central longitudinal axes of the case and shafts. The high pressure rotor shaft 24 is driven by the blades of a high pressure turbine section 26 to in turn drive the blades of a high pressure compressor 27. The low pressure rotor shaft 25 is driven by the blades of a low pressure turbine section 28 to in turn drive the blades of a low pressure compressor section 29 and a fan 30. Air passes through the engine along a core flowpath 502 sequentially compressed by the low and high compressor sections 29 and 27, then passing through a combustor 32 wherein a portion of the air is combusted along with a fuel, and then passing through the high and low turbine sections 26 and 28 where work is extracted. Additional air is driven by the fan along a bypass flowpath 504.

FIG. 2 shows the core flowpath 502 at the downstream end of the low pressure compressor section. A final ring of compressor blades 50 is mounted to an aft compressor disk 52 of the low speed spool. Upstream of the blades 50 is a ring of vanes 54 secured at their outboard ends to a compressor case assembly 56 and at their inboard ends having a seal system for sealing with the low speed spool. Downstream of the vanes 50 is an exit stator 60 having an array of vanes 62 extending between inner (inboard) and outer (outboard) stator shrouds 64 and 66. The stator shrouds have respective outboard and inboard surfaces 67 and 68 which locally form inboard and outboard boundaries of the core flowpath. At downstream ends, the shrouds 64 and 66 have mounting flanges 70 and 71 bolted to associated flanges 72 and 73 respectively extending inward and outward from respective forward portions of respective inboard and outboard walls 74 and 75 of an intermediate case 76. The inboard and outboard walls 74 and 75 (although not necessarily inboardmost and outboardmost) are connected by an array of webs or struts 77. In the exemplary embodiment, a bearing support 80 is also bolted to the flange 72 outboard of a bearing compartment.

The intermediate case 76 is an important structural element of the engine providing a load path for the engine thrust and providing transverse stiffness. Exemplary intermediate cases are formed essentially as castings with subsequent machining and addition of minor components such as threaded inserts for receiving the bolts. The shrouds 64 and 66 are subject to different loads. Although the shrouds may be of like composition (e.g., titanium alloy) to the intermediate case, they may advantageously be made in different ways (e.g., stamping of sheet stock or forging) to provide the desired strength parameters. In an exemplary method of engine assembly, the stator vanes may be preassembled to the shrouds and the stator then bolted to the intermediate case as a unit. The preassembly may involve inserting the vanes through apertures in the shrouds, with a stablug portion 84 at the tip of the vane airfoil protruding beyond the outboard surface of the outboard shroud and being sealed thereto by an encapsulant such as RTV Silicone™. At the inboard end of the airfoil, a transversely extending foot 86 may have an outboard surface facing the inboard surface of the inboard shroud (e.g., contacting). The foot may be secured to the shroud via fasteners such as rivets (not shown).

SUMMARY OF THE INVENTION

Accordingly, one aspect of the invention involves a gas turbine engine. A compressor section has a number of rings of blades and vanes. A turbine section is downstream of the compressor section along a core flowpath of the engine. An intermediate case has inboard and outboard portions forming inboard and outboard walls for the core flowpath. At least a first of the rings of the compressor section vanes extends between inboard and outboard stator shrouds. At least a first of the stator shrouds is welded to the intermediate case.

In various implementations, the compressor section may be a low pressure compressor section and the engine may further include a high pressure compressor section downstream thereof. The first ring may be a downstreammost one of the rings. The inboard and outboard stator shrouds may be respectively welded to the intermediate case inboard and outboard portions. Each of the inboard and outboard stator shrouds may be a full annulus. The first of the inboard and outboard stator shrouds may be a forging or a stamping. The intermediate case may be a casting. Each of the compressor vanes may have an inboard foot with an airfoil extending outboard from the foot. Each foot may be secured to the inboard shroud via fasteners, with an outboard surface of the foot facing an inboard surface of the inboard shroud. Each vane may extend through an associated aperture in the outboard shroud. Each vane may have a stablug and an outboard end of the airfoil protruding beyond an outboard surface of the outboard shroud and sealed relative to the outboard shroud.

Another aspect of the invention involves a method for remanufacturing such a gas turbine engine. A first of the inboard and outboard stator shrouds is removed. A replacement shroud is welded in place of the first shroud. In various implementations, replacement vanes may individually be installed to the replacement shroud in place of the first ring of the compressor vanes after the welding.

Another aspect of the invention involves a method for reengineering a gas turbine engine configuration from a first configuration to a reengineered configuration. The first configuration has compressor exit stator inboard and outboard shrouds secured to first and second portions of an intermediate case by first and second groups of fasteners. The first and second groups of fasteners are engaged to first and second groups of fastener-receiving features of the intermediate case. The initial configuration is altered to reengineered configuration having a reengineered intermediate case welded to a reengineered at least one of the exit stator inboard and outboard shrouds.

Another aspect of the invention involves a method for retrofitting a gas turbine engine. Compressor exit stator inboard and outboard shrouds are initially secured to first and second portions of intermediate case by first and second groups of fasteners engaged to first and second groups of fastener-receiving features of the intermediate case. According to the method, the shrouds are removed. A portion of the intermediate case at least partially containing at least one of the first and second groups of fastener-receiving features is then destructively removed. A replacement stator shroud may then be welded to the intermediate case.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
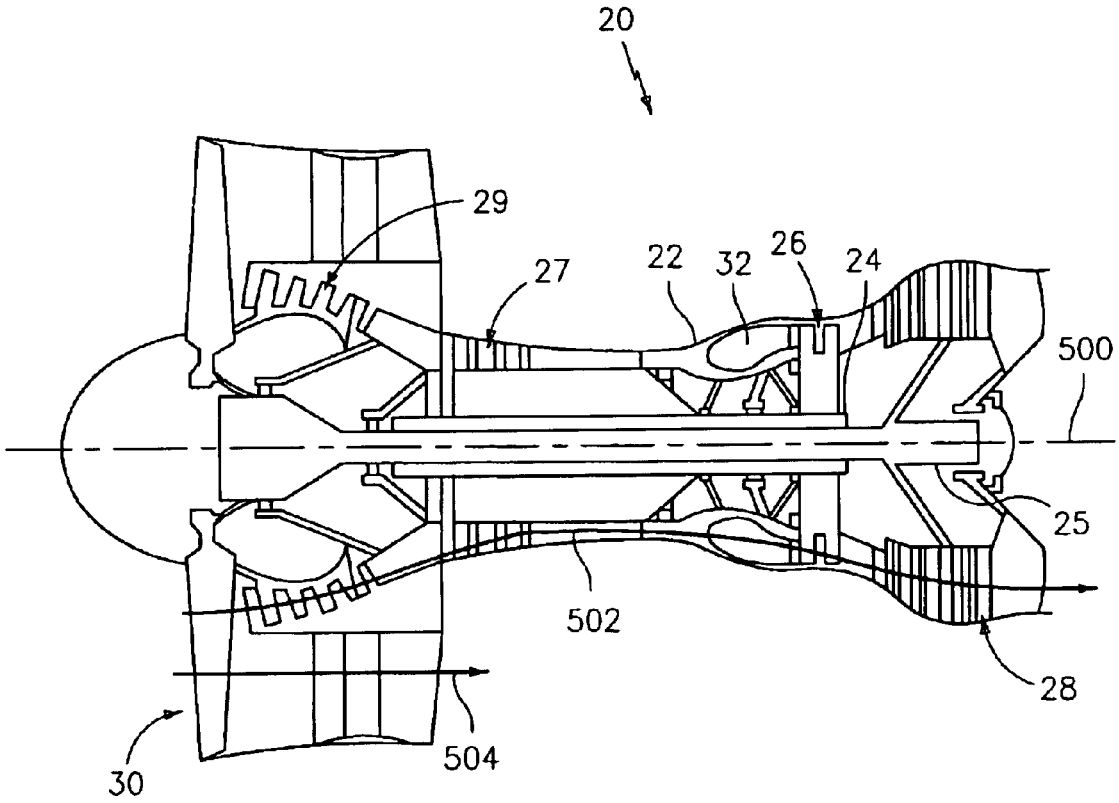
FIG. 1 PRIOR ART
FIG. 1 is a partially schematic longitudinal sectional view of an exemplary prior art gas turbine engine.
Figure 2:
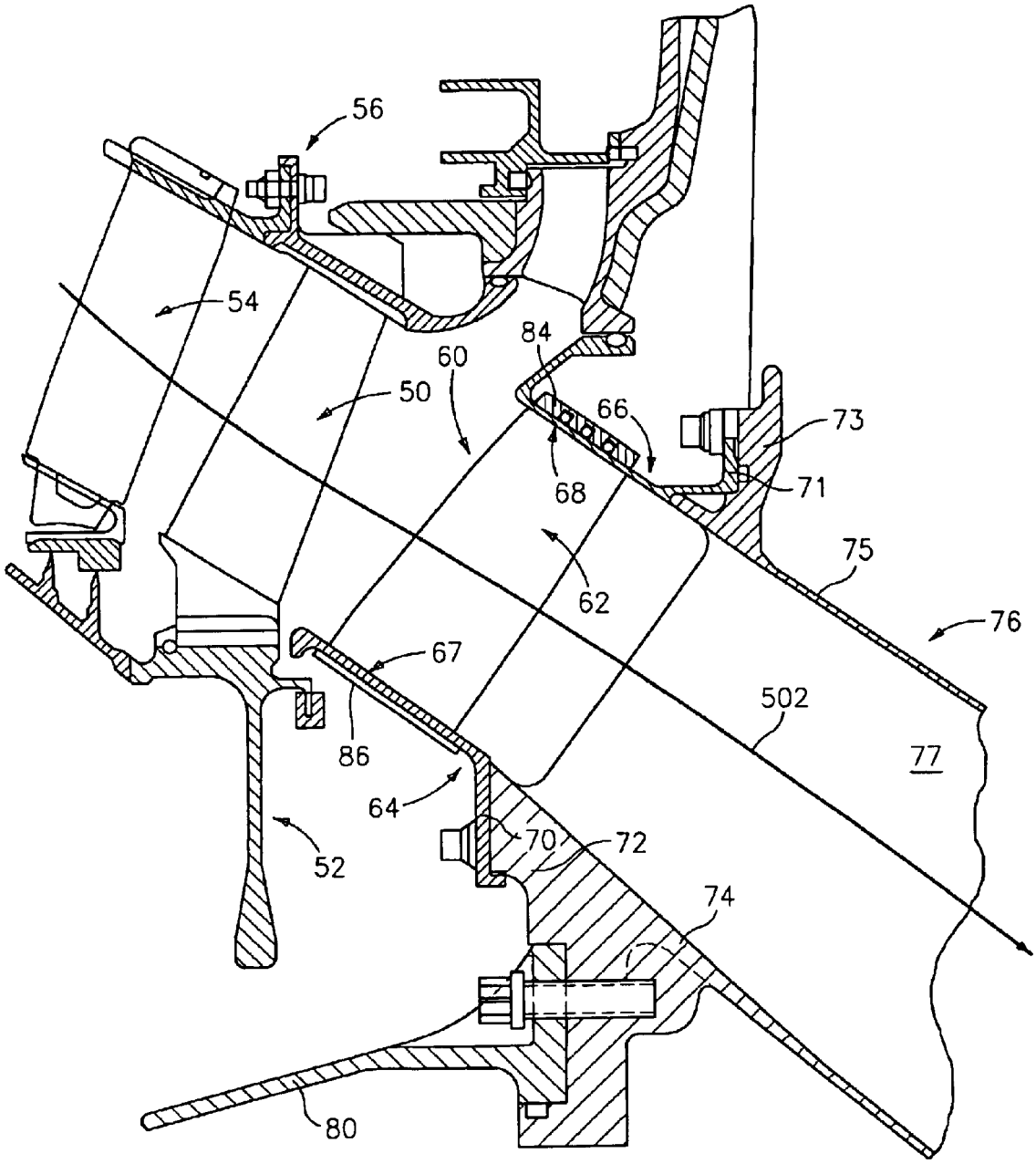
FIG. 2 PRIOR ART
FIG. 2 is a view of a compressor exit of the engine of FIG. 1.
Figure 3:
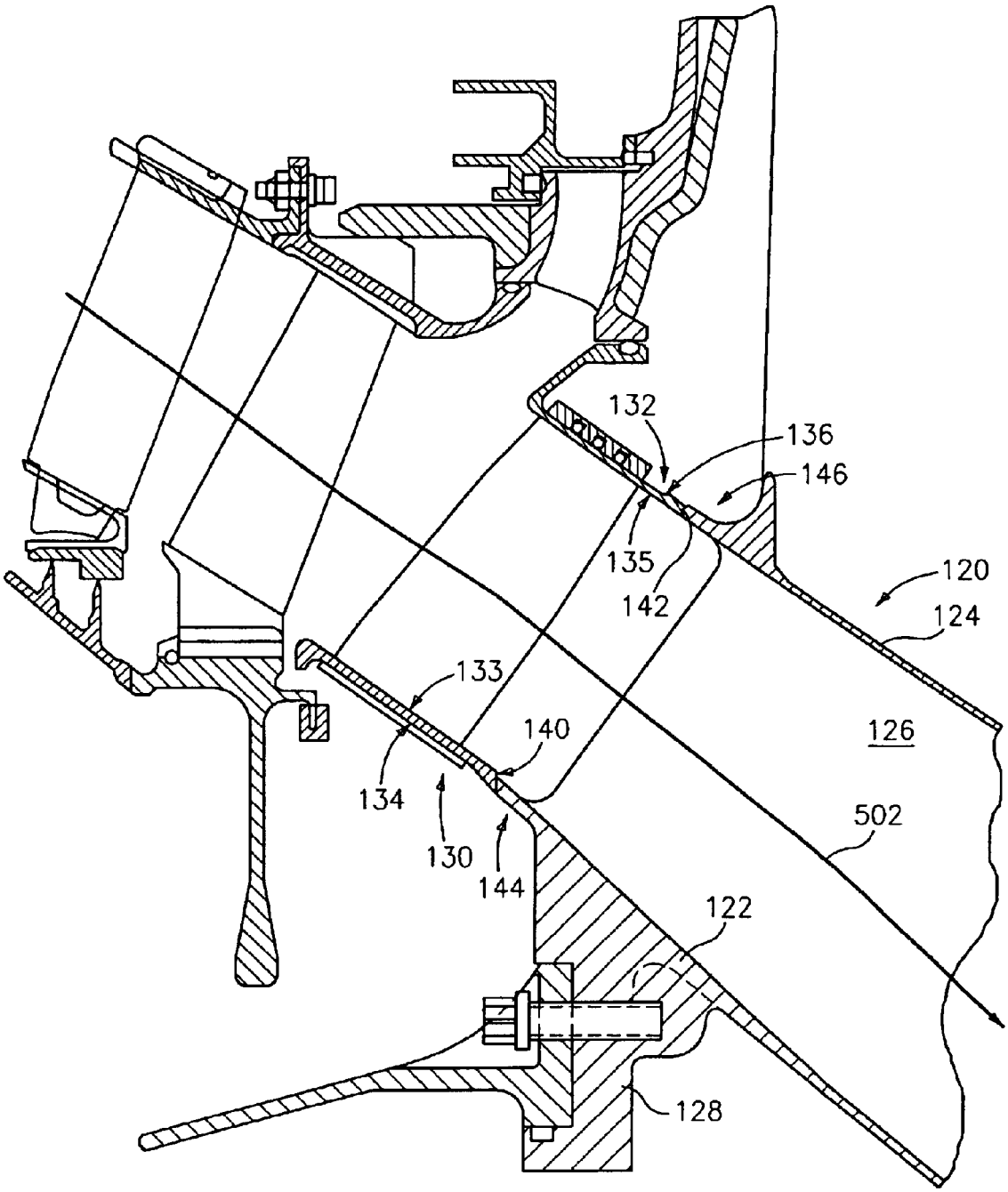
FIG. 3 is a view of a compressor exit according to principles of the invention.

FIG. 3 shows a similar portion of the flowpath 502 through an engine which may be a remanufacturing of the engine of FIG. 2 or may be of a configuration representing a reengineering of the configuration of the engine FIG.2. Like components are shown with like numbers to their counterparts of FIG. 2. An alternate intermediate case 120 has inboard and outboard walls 122 and 124 and struts 126 generally similar to analogous elements of FIG. 2. Similarly, a flange 128 extends inboard from the inboard wall 122 for connection with the bearing support. The case 120 lacks the FIG. 2 features for mounting stator shrouds. Inboard and outboard stator shrouds 130 and 132 similarly lack the FIG. 2 mounting features. In the exemplary embodiment, the inboard shroud 130 has respective outboard and inboard surfaces 133 and 134 and the outboard shroud has respective inboard and outboard surfaces 135 and 136. Aft rim portions 140 and 142 of the inboard and outboard shrouds are respectively welded to forward rim portions 144 and 146 of the intermediate case inboard and outboard walls 122 and 124. The welding saves the weight of the mounting bolts and the associated mating features of the intermediate case. Additionally, the welding potentially reduces costs through simplification of the shrouds and intermediate case and through elimination of various mounting hardware. Additionally, the use of welding may limit the chances of leakage between the shrouds and intermediate case.

An exemplary assembly method may involve first welding the shrouds to the intermediate case. The vanes may then be installed as in the prior art or otherwise. In repair situations, the vanes may be individually removed and replaced. If necessary to repair or replace one or both of the shrouds, such shroud(s) may be cut off or unwelded and replacement shroud(s) welded in place. To permit such rewelding, advantageously, the forward rim portions of the intermediate case walls may be slightly thickened relative to other portions.

One or more embodiments of the present invention have been described. Nevertheless, it will be understood that various modifications may be made without departing from the spirit and scope of the invention. For example, the invention may be applied to a variety of existing turbine engine configurations or to configurations yet developed. When applied as a reengineering, the engineering may include additional changes while leaving other aspects of the engine unchanged. In some situations it may be desired that only one of the shrouds be welded in place. Accordingly, other embodiments are within the scope of the following claims.

What is claimed is:

1. A gas turbine engine comprising:

a first compressor section having a plurality of rings of blades and vanes;

a second compressor section downstream of the first compressor section along a core flowpath of the engine;

a turbine section downstream of the second compressor section; and an intermediate case having inboard and outboard portions forming inboard and outboard walls for the core flowpath;

wherein at least a first of said rings of said first compressor section vanes extends between inboard and outboard stator shrouds, at least a first of which is welded to the intermediate case.

2. The engine of claim 1 wherein said first of said rings is a downstream most of said rings.

3. The engine of claim 1 wherein:

the inboard and outboard stator shrouds are respectively welded to the intermediate case inboard and outboard portions.

4. The engine of claim 1 wherein:

said first of the inboard and outboard stator shrouds is a full annulus.

5. The engine of claim 1 wherein:

said first of the inboard and outboard stator shrouds is a forging or a stamping; and said intermediate case is a casting.

6. The engine of claim 1 wherein:

each of the compressor vanes has an inboard foot, an airfoil extending outboard from the foot;

each foot is secured to the inboard shroud via fasteners, with an outboard surface of the foot facing an inboard surface of the inboard shroud; and each vane extends through an associated aperture in the outboard shroud.

7. The engine of claim 6 wherein:

each vane has a stablug at an outboard end of the airfoil protruding beyond an outboard surface of the outboard shroud and sealed relative to the outboard shroud.

8. A method for remanufacturing the gas turbine engine of claim 1 comprising:

removing said first of the inboard and outboard stator shrouds; and welding a replacement shroud in place of said first of the inboard and outboard stator shrouds.

9. The method of claim 8 further comprising:

individually installing replacement vanes to said replacement shroud in place of said first ring of said compressor vanes after said welding.

10. A method for reengineering a gas turbine engine configuration from a first configuration having compressor exit stator inboard and outboard shrouds secured to first and second portions of an intermediate case by first and second pluralities of fasteners engaged to first and second pluralities of fastener-receiving features of the intermediate case, the method comprising:

altering the initial configuration to a reengineered configuration having a reengineered intermediate case welded to a reengineered at least one of exit stator inboard and outboard shrouds.

11. A method for retrofitting a gas turbine engine comprising:

removing compressor exit stator inboard and outboard shrouds initially secured to first and second portions of an intermediate case by first and second pluralities of fasteners engaged to first and second pluralities of fastener-receiving features of the intermediate case;

destructively removing a portion of the intermediate case at least partially containing at least one of said first and second pluralities of fastener-receiving features.

12. The method of claim 11 further comprising:

welding at least one replacement stator shroud to the intermediate case.

13. The engine of claim 1 wherein:

the intermediate case inboard and outboard portions are connected by an array of struts adjacent the exit stator.

14. A gas turbine engine comprising:

a low pressure compressor compressor section having a plurality of rings of blades and vanes;

a high pressure compressor section downstream of the low pressure compressor section along a core flowpath of the engine;

a high pressure turbine section downstream of the low pressure compressor section along the core flowpath;

a low pressure turbine section downstream of the high pressure turbine section along the core flowpath; and an intermediate case having inboard and outboard portions forming inboard and outboard walls for the core flowpath, wherein at least an exit stator one of said rings of said low pressure compressor section vanes extends between inboard and outboard stator shrouds, at least a first of which is welded to the intermediate case.

15. The engine of claim 14 wherein:

the inboard and outboard stator shrouds are respectively welded to the intermediate case inboard and outboard portions.

16. The engine of claim 14 wherein:

said first of the inboard and outboard stator shrouds is a full annulus.

17. The engine of claim 14 wherein:

said first of the inboard and outboard stator shrouds is a forging or a stamping; and said intermediate case is a casting.

18. The engine of claim 14 wherein:

the intermediate case inboard and outboard portions are connected by an array of struts adjacent the exit stator.

19. A gas turbine engine comprising:

a compressor section having a plurality of rings of blades and vanes;

a turbine section downstream of the compressor section; and an intermediate case having inboard and outboard portions forming inboard and outboard walls for a core flowpath;

wherein:

at least a first of said rings of said compressor section vanes extends between inboard and outboard stator shrouds;

at least a first of the inboard and outboard stator shrouds is welded to the intermediate case.

each of the compressor vanes of the first of the rings has an inboard foot, and an airfoil extending outboard from the foot;

each foot is secured to the inboard shroud via fasteners, with an outboard surface of the foot facing an inboard surface of the inboard shroud; and each of the compressor vanes of the first of the rings extends through an associated aperture in the outboard shroud.

20. The engine of claim 19 wherein:

each of the compressor vanes of the first of the rings has a stablug at an outboard end of the airfoil protruding beyond an outboard surface of the outboard shroud and sealed relative to the outboard shroud.

* * * * *

UNITED STATES PATENT AND TRADEMARK OFFICE

CERTIFICATE OF CORRECTION

PATENT NO. : 6,881,032 B2
DATED : April 19, 2005
INVENTOR(S) : Eric W. Malmborg

It is certified that error appears in the above-identified patent and that said Letters Patent is hereby corrected as shown below:

Column 5,
Line 16, "compressor" (second occurrence) should be deleted.

Column 6,
Line 23, after "case" the "." should be deleted and a -- ; -- should be inserted.

Signed and Sealed this

Sixteenth Day of August, 2005

JON W. DUDAS
*Director of the United States Patent and Trademark Office*